US007073492B2

(12) United States Patent
Hoffmann et al.

(10) Patent No.: US 7,073,492 B2
(45) Date of Patent: Jul. 11, 2006

(54) CYLINDER CRANKCASE, PROCEDURE FOR MANUFACTURING THE CYLINDER BUSHINGS FOR THE CYLINDER CRANKCASE, AND PROCEDURE FOR MANUFACTURING THE CYLINDER CRANKCASE WITH THESE CYLINDER BUSHINGS

(75) Inventors: Dietmar Hoffmann, Munich (DE); Josef Steibl, Unterschleissheim (DE); Frank Dornenburg, Essen (DE); Markus Nolte, Paderborn (DE); Achim Sach, Langenargen (DE); Berthold Aumuller, Weiden (DE); Klaus Dotzler, Vilseck (DE)

(73) Assignees: Atz-Evus Applikations-Und Technikzentrum, Sulzbach-Rosenberg (DE); Hyrdro Aluminium Deutschland GmbH, Cologne (DE)

( * ) Notice: Subject to any disclaimer, the term of this patent is extended or adjusted under 35 U.S.C. 154(b) by 152 days.

(21) Appl. No.: 10/672,237

(22) Filed: Sep. 25, 2003

(65) Prior Publication Data

US 2004/0154577 A1 Aug. 12, 2004

Related U.S. Application Data

(63) Continuation of application No. 09/833,032, filed on Apr. 11, 2001, now abandoned, which is a continuation of application No. PCT/EP00/07615, filed on Aug. 5, 2000.

(30) Foreign Application Priority Data

Aug. 11, 1999 (DE) ..... 199 37 934

(51) Int. Cl.
*F02B 75/08* (2006.01)
*F02F 1/00* (2006.01)

(52) U.S. Cl. ..... 123/669; 123/668; 123/195 R; 123/193.2

(58) Field of Classification Search ..... 123/195 R, 123/193.2, 193.1, 193.5
See application file for complete search history.

(56) References Cited

U.S. PATENT DOCUMENTS 4,532,896 A * 8/1985 Nakahara et al. ..... 123/193.5
5,183,025 A * 2/1993 Jorstad et al. ..... 123/669
5,305,726 A * 4/1994 Scharman et al. ..... 123/668
5,315,970 A * 5/1994 Rao et al. ..... 123/193.2
5,363,821 A * 11/1994 Rao et al. ..... 123/193.2
5,408,964 A * 4/1995 Rao ..... 123/193.2

(Continued)

FOREIGN PATENT DOCUMENTS

DE 4212716 A1 10/1993

(Continued)

OTHER PUBLICATIONS

"Fachbeiträge—Stand des thermischen Spritzens" —Dr.-Ing. Hans-Michael Höhle, Hattersheim, Schweissen und Schneiden 45 (1993), pp. 75-80.

(Continued)

*Primary Examiner*—Henry C. Yuen
*Assistant Examiner*—Jason Benton
(74) *Attorney, Agent, or Firm*—Proskauer Rose LLP

(57) ABSTRACT

A light metal cylinder crankcase for combustion engines has cylinder bushings with a running layer that forms the running surface and a rough, external bonding layer for bonding the cylinder bushings to the cylinder crankcase while pouring the cylinder crankcase. At least 60% of the bonding layer relative to the jacket surface of the bonding layer is connected with the casting material of the cylinder crankcase in a material tight manner.

29 Claims, 1 Drawing Sheet

U.S. PATENT DOCUMENTS

| | | | | | |
|---|---|---|---|---|---|
| 5,592,927 | A | * | 1/1997 | Zaluzec et al. | 123/668 |
| 5,598,818 | A | * | 2/1997 | Domanchuk | 123/193.2 |
| 5,820,938 | A | * | 10/1998 | Pank et al. | 427/449 |
| 5,829,405 | A | | 11/1998 | Gödel | 123/193.2 |
| 6,044,820 | A | * | 4/2000 | Domanchuk et al. | 123/193.2 |
| 6,074,763 | A | | 6/2000 | Rueckert et al. | 428/577 |
| 6,095,126 | A | * | 8/2000 | Kloft et al. | 123/668 |

FOREIGN PATENT DOCUMENTS

| | | | |
|---|---|---|---|
| DE | 19605946 | C1 | 7/1997 |
| DE | 19634504 | A1 | 12/1997 |
| DE | 19745725 | A1 | 1/1999 |
| EP | 0659899 | A1 | 6/1995 |
| JP | 10299568 | | 11/1998 |

OTHER PUBLICATIONS

"Microstructure—Property Relationship and Cross-Property-Correlations of Thermal Sprayed Ni-Alloy Coating" Authors N. Margadant, S. Siegmann, J. Patscheider EMPA, Thermal Spraying 2001—New Surfaces for a New Millenium (2001), pp. 643-652.

"Ceramic Coatings Produced By a 200Kw Liquid-Stabilized Plasma Gun"—Dr. Grasme, DVS 130, pp. 14-18.

Plasma Sprayed Ceramic Shapes For High Temperature Applications—E.H. Lutz, DVS 175, pp. 167-175.

* cited by examiner

CYLINDER CRANKCASE, PROCEDURE FOR MANUFACTURING THE CYLINDER BUSHINGS FOR THE CYLINDER CRANKCASE, AND PROCEDURE FOR MANUFACTURING THE CYLINDER CRANKCASE WITH THESE CYLINDER BUSHINGS

CROSS-REFERENCE TO RELATED APPLICATIONS

This application is a continuation of U.S. patent application Ser. No. 09/833,032, filed Apr. 11, 2001, now abandoned, which is a continuation of PCT International Application No. PCT/EP00/07615, filed Aug. 5, 2000, now abandoned, both of which are hereby incorporated by reference herein in their entireties.

BACKGROUND OF THE INVENTION

The invention relates to a light metal cylinder crankcase for combustion engines wherein the light metal cylinder crankcase includes cylinder bushings. It also relates to a procedure for manufacturing cylinder bushings for a cylinder crankcase and to a procedure for manufacturing a cylinder crankcase with such cylinder bushings.

For purposes of lightweight construction, grey cast iron is currently being substituted by aluminum alloys in cylinder crankcases of combustion engines for motor vehicles. While grey cast iron is also suitable for the cylinder bearing surface, aluminum cast alloys are reinforced in this area by cylinder bushings.

Known from DE 196 05 946 C1 is a cylinder bushing made out of a molybdenum running layer and an outside aluminum alloy layer, whose outside is profiled. Both layers are formed via thermal spraying on a rotating mandrel. Using molybdenum, an anti-adhesive, a mandrel with a hard chromium layer, etc. reduces the adhesion of the running layer to the mandrel to a point where the bushings can be taken off the mandrel.

When casting the cylinder crankcase, the cylinder bushings arranged on barrels in the mold with their profiled outside surface are positively joined with the casting material. The heavy molybdenum running layer gives the known cylinder bushing considerable weight. In addition, there is a danger that the bushings will loosen, the cylinder will shift, and hence the blow-by values will increase. Residues from the combustion process can also get into the micro-gap at the phase boundary between the casting material and the bushings.

To improve the bonding of the cylinder bushing to the casting material of the cylinder crankcase, DE 196 34 504 A1 describes abrasive blasting of the surface of the cylinder bushing with sharp-edged particles to achieve a roughness of 30–60 μm in the form of pyramidal protuberances.

Since the oxide skin on an aluminium body to be poured into an aluminium casting material prevents bonding to the casting material, DE 197 45 725 A1 describes mechanically destroying the oxide skin on the pouring body through thermal spraying, wherein the resultant oxide particles are distributed in the spraying layer. In addition, the spraying material particles that did not completely melt on impact project out of the spraying layer, which improves the connection with the casting material. A nickel or molybdenum alloy is used as the spraying material.

BRIEF SUMMARY OF THE INVENTION

The object of the invention is to provide a lightweight, easily manufactured cylinder bushing, which leads to a flawless, rigid bonding to the casting material of the cylinder crankcase for the life cycle of the combustion engine.

This is achieved according to the invention with a light metal cylinder crankcase for combustion engines with cylinder bushings, having a running layer that forms a running surface and a rough external bonding layer for bonding the cylinder crankcase. At least 60% of the bonding layer relative to the jacket surface of the bonding layer is connected with the casting material of the cylinder crankcase in a material tight manner. In some advantageous embodiments of the cylinder crankcase according to the invention the level of material tight bond between the bonding layer and the casting material measures at least 90%. The bonding layer may have an open porosity generated by thermal spraying. The open porosity of the bonding layer may measure at least 10% by volume. The bonding layer and casting material may include an aluminum or magnesium alloy. The bonding layer and casting material and the running layer may each include an aluminum or magnesium alloy. The running layer of the cylinder bushing may include an aluminum-silicon allow with a high silicon content, the casting material may include an aluminum-silicon alloy with a low silicon content, and the bonding layer may include an aluminum-silicon alloy with a silicon content lying between the silicon content of the running layer and the casting material. In a preferred procedure for manufacturing the cylinder bushings, the cylinder bushings may be manufactured by thermally spraying the running layer on a mandrel serving as a molded part, and thermally spraying the bonding layer on the running layer in such a way that the bonding layer has an open porosity of at least 10% v/v (by volume). The bonding layer may be sprayed with a spraying powder having an average grain size of between 60 μm and 400 μm. The bonding layer may be thermally sprayed via flame or plasma spraying. The running layer may be sprayed using a spraying material including an aluminum-silicon alloy. The aluminum-silicon allow may have a silicon content of 12% to 50% w/w (by weight). The spraying material may include iron, nickel, magnesium, and/or copper in an amount equal to 0.5% to 2.0% relative to the weight of the alloy as additional alloy constituents. The running layer may be sprayed with a spraying powder having a grain size of less than 150 μm. A carrier layer may be sprayed onto the mandrel before spraying on the running layer. A spraying material including tin, zinc, aluminum, and/or an alloy of these metals may be used for the carrier layer. The carrier layer may be removed from the running layer via machining. The carrier layer may be removed once the running layer of the cylinder bushing poured into the cylinder crankcase has been sized to its cylindrical operating dimensions via machining. The mangrel may be made to rotate during the thermal spraying of the carrier layer, running layer and/or bonding layer. The mandrel may be shrunk via quenching before the mandrel is removed from the sill-heated thermally sprayed cylinder bushing. The cylinder bushing may be subjected to heat treatment at a temperature between 300° C. and 550° C. In a preferred procedure for manufacturing the cylinder crankcase, the temperature of the smelt may exceed the melting point of the bonding layer while pouring the cylinder crankcase. In some advantageous embodiments, the cylinder crankcase may be poured using a pressure-assisted procedure. In some advantageous embodiments, the pressure-assisted pouring may be performed at a gating rate exceeding 1 m/sec.

DETAILED DESCRIPTION OF THE INVENTION

Figure 1:
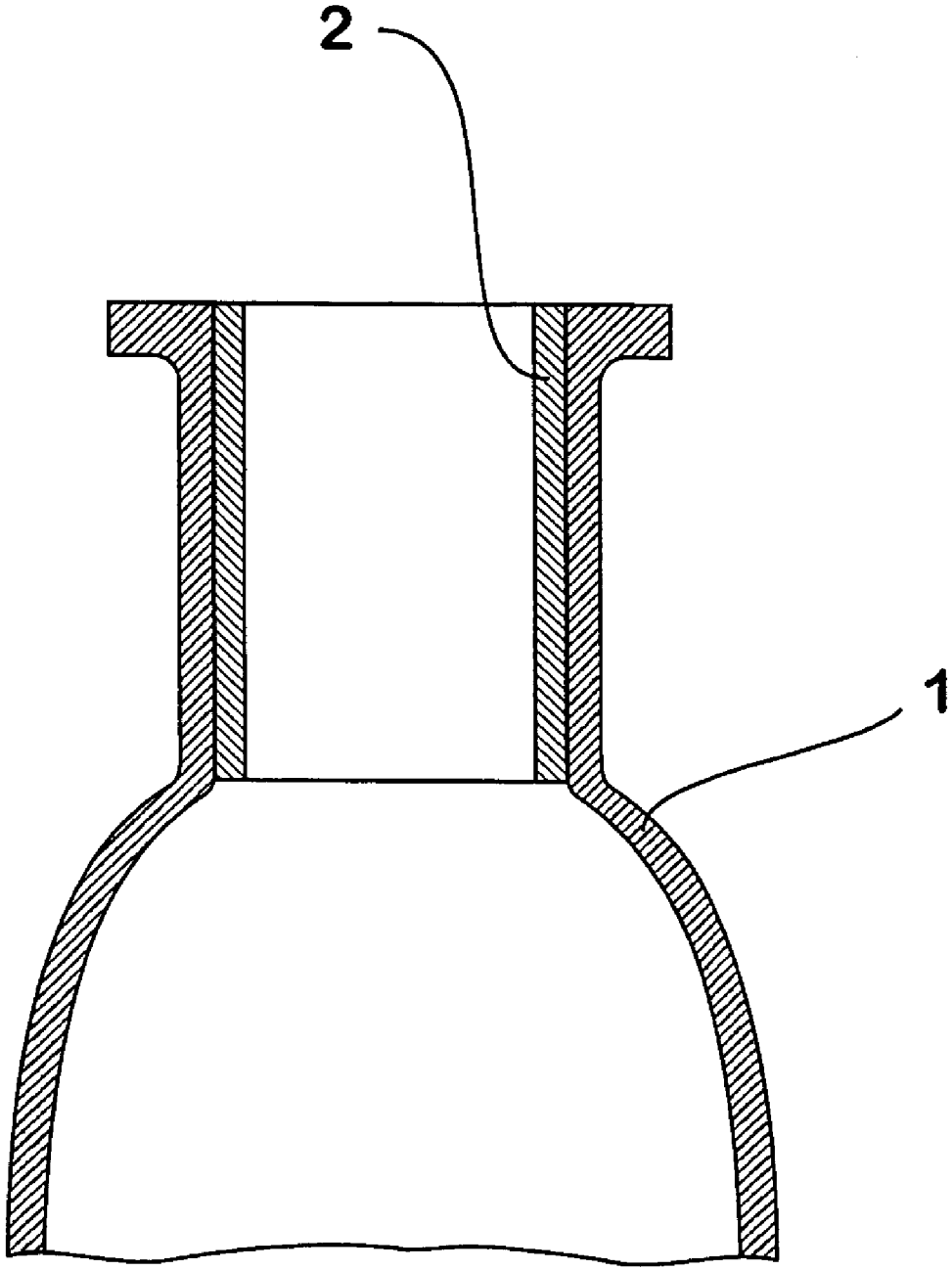
FIG. 1 shows a light metal cylinder crank case 1 with a cylinder liner or bushing 2 in accordance with the present invention. The boundary between the cylinder crankcase 1 and the bushing 2 serves as a bonding layer which improves bonding between the bushing and the casting material forming the crankcase during the casting process as described below.

In the cylinder crankcase according to the invention, the outside bonding layer of the cylinder bushing is formed by thermal spraying, performed in such a way as to form a spraying layer with a high open porosity of at least 10% v/v, in particular 30–70% v/v.

The layer thickness of the bonding layer preferably measures 60 μm –800 μm. To bind a high open porosity, the bonding layer is preferably generated with a coarse-grained spraying powder with a grain size of 60 μm–400 μm, in particular 90 μm–250 μm. Therefore, the average grain size of the spraying powder in the bonding layer preferably measures more than 100 μm, in particular more than 130 μm. When using such a coarse-grained spraying powder to spray a very thin bonding layer, only one layer with the correspondingly high roughness can be formed instead of an open porous layer.

While casting light metal cylinder crankcase, the open, porous or rough layer formed in this way results in a material tight connection between the cylinder bushing and the cylinder crankcase.

In a molten state, light metals, i.e., in particular aluminum and magnesium and alloys thereof, form an outside oxide skin produced by the reaction of the light metal and the ambient oxygen. The oxide skin protects the melt flowing inside against further oxidation.

When pouring in the cylinder bushings, contact between the oxide skin and cylinder bushing surface initially takes place as the molten metal flows in. Due to its chemical stability and low tendency toward wetting relative to solid bodies, e.g., the cylinder bushings, the oxide skin does not contribute to the connection between the solid body and surrounding casting material. Therefore, only a very limited material tight connection can be achieved in previous bushing systems.

The high roughness or open porosity of the bonding layer of the cylinder bushing according to the invention causes the oxide skin of circulating light molten metal to tear open from time to time, so that there is direct contact between the melted mass and the surface of the bonding layer. The oxide skin of the melted mass is uninterruptedly penetrated by the fine tips of the porous, rough surface of the bonding layer generated through thermal spraying.

After the oxide skin tears, the smelt infiltrates the porous bonding layer. This leads to direct contact between the melted mass and the bonding layer surface, producing a material tight connection. In addition, the high level of heat supplied from the surrounding casting material to the bonding layer causes the bonding layer to melt open on the surface. This produces a high degree of material tight bond between the bonding layer of the cylinder bushing and the cylinder crankcase. In other words, according to the invention, at least 60%, preferably at least 80%, and in particular at least 90% of the bonding layer of the cylinder bushing relative to the cylindrical jacket surface of the bonding layer is connected with the casting material of the cylinder crankcase in a material tight manner. The bonding level can here be determined by ultrasound.

The material tight bond of the cylinder bushings to the surrounding casting material ensures a flawless anchoring of the cylinder bushings in the cylinder crankcase for the lifetime of the combustion engine. The material tight bond results in a smooth flow of heat through the phase boundaries. This also prevents thermally induced warping.

The thermally sprayed, tribologically optimised cylinder bushings according to the invention can be poured into commercially available, inexpensive aluminum alloys.

The advantage to thermal spraying is that a nearly freely selectable material composition reflecting local requirements is possible, in comparison to other techniques. In this case, the cylinder bushing manufactured according to the invention via thermal spraying can be adapted in terms of alloy composition relative to both its tribological properties on the bearing surface and to the bonding properties on the motor block side. The material comprising the cylinder bearing surface must also be corrosion resistant. In addition, it must lend itself to machining, so that the cylinder bushing can be sized to operating dimensions after poured.

A carrier layer is preferably first thermally sprayed onto a mandrel as the molded part according to the invention to manufacture the cylinder bushing. After the carrier layer has been sprayed on, the running layer is applied through thermally spraying, and then the bonding layer is applied on the running layer through thermal spraying.

The cylinder bushing blank fabricated in this way is then removed from the mandrel, wherein the slight adhesion of the carrier layer to the mandrel makes it easier to detach the blank from the mandrel.

The blanks are situated in the casting mold on barrels for manufacturing the cylinder crankcase. After casting and removing the cylinder crankcase from the mold, the carrier layer is removed and the running layer is sized to operating dimensions via machining.

All known procedural variations can be used for thermal spraying; this to applies both the spraying materials (powder or wire) and the type of energy source (flame, electric arc, plasma).

To ensure that the cylinder bushing according to the invention has a sufficient dimensional stability, it preferably has a wall thickness of 1 mm to 5 mm. Therefore, the bushing can be stored and handled without any problems from manufacture to pouring. Cylinder bushings can be manufactured according to the invention with standard diameters and lengths for all common engine types.

The mandrel preferably consists of tool steel or another material that is not melted open during thermal spraying. The mandrel is made to rotate during the thermal spraying of the individual layers of the cylinder bushing according to the invention.

The mandrel has the same dimensions as the barrels so that the bushings can be form-fit on the barrels while pouring. Accordingly, the mandrel can be conically designed with the same cone angle, e.g., 0.5° as the sleeves, so that the cylinder bushing blanks can be slipped onto the sleeves in a form-fitting manner.

To simplify the removal of the cylinder bushing blank from the mandrel, the mandrel can be hollow, so that it can be cooled with a medium, e.g., water. After thermal spraying, the mandrel can then be shrunk out of the still hot thermal cylinder bushing blank via cooling. The mandrel can also be removed by pressing it out of the cylinder bushing blank.

According to the invention, all known spraying procedures can be used as the thermal spraying procedure. Only one spraying procedure need be used for manufacturing the entire cylinder bushing. For economic reasons and in view of the respective layer properties, however, a combination of different procedures is preferably used.

The carrier layer is preferably manufactured via flame spraying with spraying wire, since this procedure is particularly cost effective. Preferably tin, zinc, aluminum and alloys thereof are used as the spraying materials for the carrier layer, since they yield a sufficient adhesion of the carrier layer to the mandrel, and also ensure that the completely sprayed bushing can be easily detached from the mandrel. The carrier layer preferably has a thickness of 20 μm to 500 μm, in particular 50 μm to 100 μm. The carrier layer is generally required in the cylinder bushing according to the invention in particular when the running layer consists of a light metal alloy that would adhere to the mandrel in such a way without a carrier layer that the cylinder bushing could not be detached from the mandrel without any destruction.

For reasons of weight, the running layer according to the invention consists of a light metal alloy, in particular an aluminum or magnesium alloy, namely a tribologically suitable, corrosion-resistant light metal alloy, and is preferably an aluminum-silicon alloy with an Si content in particular of 12 to 50% w/w. The tribological properties may leave something to be desired at an Si content of <12% w/w, while the material is most often brittle, and hence difficult to process, at an Si content of >50% w/w.

The light metal alloy can contain other tribologically active additives, e.g., silicon carbide, graphite or molybdenum.

If an Al—Si alloy is used for the running layer, it can additionally contain the following alloy constituents by weight:

Fe: 0.5–2.0%, preferably 0.5–1.5%

Ni: 0.5–2.0%, preferably 0.5–1.5%

Mg: 0.5–2.0%, preferably 0.5–1.5%

Cu: 0.5–2.0%, preferably 0.5–1.5%

These alloy constituents increase the hardness and heat resistance of the running layer.

The running layer can be manufactured via atmospheric plasma spraying (APS), flame spraying and high-velocity flame spraying (HVOF) with a spraying powder. Use can also be made of a special procedure in the area of high-velocity flame spraying, which has become known under the name CGDM (cold-gas dynamic spray method).

When using a spraying powder, the average grain size preferably lies under 100 μm, in particular under 80 μm, wherein a sieve fraction of between 10 μm and 125 μm is preferably used to achieve a tribologically suitable corrosion-proof and machinable running surface. However, the running surface can also be manufactured with wire spraying materials, e.g., via wire flame spraying or arc spraying. Given the wide range of materials, however, powder spraying is generally preferred.

In the completely processed state, the running layer in the cylinder crankcase preferably has a thickness of 0.5 mm to 3 mm, in particular 1 mm to 2 mm.

The porous bonding layer of the cylinder bushing according to the invention can be formed through the use of a spraying powder with a corresponding high grain size and a suitable thermal spraying procedure. To this end, the spraying powder preferably has an average grain size of between 60 μm and 400 μm, in particular exceeding 100 μm, in particular exceeding 150 μm. A sieve fraction of between 90 μm and 250 μm is preferably used. All powder procedures can be used as the thermal spraying procedure, in particular flame or plasma spraying. A spraying distance of 50 mm to 400 mm, in particular 100 mm to 250 mm, can be used for flame spraying.

However, a spraying wire can also be used, wherein the porosity of the bonding layer is then achieved by setting the appropriate process parameters, e.g., a greater spraying distance.

To ensure a material tight bond to the casting material comprised of light metal, the spraying material for the bonding layer consists of a similar type of light metal alloy. This means that, since the casting material is normally an aluminum alloy, the bonding layer also consists of an aluminum alloy. However, the casting material and bonding layer can also consist of a magnesium alloy, for example.

The material used for spraying the bonding layer is preferably adapted to the running layer material on the one hand, and the casting material on the other. In other words, if the casting alloy consists of an Al—Si alloy and the running layer consists of an Al—Si alloy, an Al—Si alloy is preferably also used for the bonding layer. The Si content of the Al—Si alloy of the bonding layer here preferably ranges between the Si content of the Al—Si casting alloy and that of the running layer alloy. In other words, if a casting alloy comprised of Al—Si with an Si content of 9 to 10% w/w and a running layer comprised of Al—Si with an Si content of 25% w/w are used, the Si content of the Al—Si alloy of the bonding layer can range between 10 and 25% w/w, for example. It is also possible to implement a gradated transition for the bonding layer composition between the running layer and the casting alloy by correspondingly changing the spraying material while spraying the bonding layer. The process parameters can also be changed to alter the porosity of the bonding layer from the running layer to the casting material.

Using similar procedures and materials for the running layer and bonding layer results in an intimate bond between the running layer and bonding layer. At the same time, the open porous structure of the bonding layer leads to a material tight bond of the casting alloy, not only to the surface of the bonding layer, but deep into the layer.

The bonding layer thickness can range between 60 μm and 800 μm, and preferably lies between 100 μm and 500 μm.

The thermally sprayed cylinder bushing blank manufactured in this way can be poured into the cylinder crankcase immediately after the spraying process.

However, the cylinder bushing blank is preferably subjected to heat treatment before poured, to achieve a stable structure through artificial ageing.

Heat treatment can be performed at a temperature of between 300° C. and 550° C. for a half an hour to several hours.

While pouring the cylinder crankcase, the melted mass temperature preferably exceeds the melting point of the bonding layer of the cylinder bushing, so as to melt the bonding layer to its surface while casting to improve the material bond.

The formation of a boundary surface between the casting material and cylinder bushing is influenced greatly by the pouring procedure used. While the gravitational procedure can be used for pouring, pressure-supported pouring procedures are preferred over no-pressure pouring procedures according to the invention.

In pressure-assisted pouring procedures, applying an outside force while filling the casting mold and during the setting process further increases the level of material tight bond. This holds true in particular when pouring with a pressure-assisted procedure at a gating rate of more than 1 m/s. In pressure-assisted pouring procedures, in particular high- and medium-pressure pouring procedures, the melted mass is pressed into even the finest of hollows. The complete closure with a greatly enlarged surface yields ideal conditions for a material tight connection as well. The specific setting of the mold fill rate and temperature ranges makes it possible to further optimize the material bond. The following example is intended to further explain the invention.

EXAMPLE

A mandrel (hollow mandrel) made of tool steel with an amount of taper of 0.5° is allowed to rotate at a speed of 180 RPM. A zinc wire is used to flame spray an externally cylindrical carrier layer with a thickness of approx. 70 μm onto the mandrel at a spraying distance of approx. 100 μm to 150 μm.

At the same rotational velocity and spraying distance, a 2 mm thick running surface layer is applied to the carrier layer via plasma spraying with an Al—Si alloy powder having an Si content of 25% w/w and a grain size (sieve fraction) of 10 μm to 125 μm. At the same rotational velocity of the mandrel and identical spraying distance, a roughly 300 μm thick bonding layer is then applied via flame spraying with an Al—Si alloy powder having an Si content of 15% w/w and a grain size (sieve fraction) of 90 μm to 250 μm.

The mandrel is quenched with cold water, and thereby detached from the still hot cylinder bushing blank via shrinking.

The blank is then placed on the barrel in a casting mold, and poured in via pressure casting with an Al—Si alloy having an Si content of 9% w/w. After removal from the mold, the carrier layer is removed via machining, and the running layer is sized to the cylindrical operating dimensions.

An ultrasonic analysis reveals that over 90% of the bonding layer relative to the cylindrical jacket surface of the bonding layer is bound with the casting material in a material tight manner.

The invention claimed is:

1. A light metal cylinder crankcase for a combustion engine, the cylinder crankcase comprising:

casting material; and cylinder bushings, each cylinder bushing having a running layer that forms a running surface and a rough external bonding layer for bonding the cylinder bushing to the cylinder crankcase while pouring the cylinder crankcase;

wherein at least 60% of the bonding layer relative to the jacket surface of the bonding layer is connected with the casting material of the cylinder crankcase in a material tight manner, wherein the bonding layer has an open porosity of at least 10% v/v generated by the thermal spraying with a spraying powder having an average grain size of between 60 μm and 400 μm.

2. The cylinder crankcase according to claim 1 wherein the level of material tight bond between the bonding layer and casting material measures at least 90%.

3. The cylinder crankcase according to claim 1 wherein the bonding layer has a layer thickness of 50 μm to 800 μm.

4. The cylinder crankcase according to claim 1 wherein the bonding layer and the casting material each comprises an aluminum or magnesium alloy.

5. The cylinder crankcase according to claim 4 wherein the running layer comprises an aluminum or magnesium alloy.

6. The cylinder crankcase according to claim 4 or 5 wherein:

the running layer of the cylinder bushing comprises an aluminum-silicon alloy with a high silicon content;

the casting material of the cylinder crankcase comprises an aluminum-silicon alloy with a low silicon content; and the bonding layer comprises an aluminum-silicon alloy with a silicon content lying between the silicon content of the running layer and the silicon content of the casting material.

7. A procedure for manufacturing a cylinder bushing for a light metal cylinder crankcase for a combustion engine, the cylinder crankcase having casting material and cylinder bushings, each bushing having a running layer that forms a running surface and a rough external bonding layer for bonding the cylinder bushing to the cylinder crankcase while pouring the cylinder crankcase, wherein at least 60% of the bonding layer relative to the jacket surface of the bonding layer is connected with the casting material of the cylinder crankcase in a material tight manner, the procedure comprising:

thermally spraying the running layer on a mandrel, the mandrel serving as molded part; and thermally spraying the bonding layer on the running layer, wherein the bonding layer is thermally sprayed in such a way that the bonding layer has an open porosity of at least 10% v/v.

8. The procedure according to claim 7 wherein the thermally spraying bonding layer comprises spraying the bonding layer with a spraying powder having an average grain size of between 60 μm and 400 μm.

9. The procedure according to claim 7 wherein the thermally spraying the bonding layer comprises flame spraying or plasma spraying.

10. The procedure according to claim 8 wherein the thermally spraying the bonding layer further comprises flame spraying or plasma spraying.

11. The procedure according to claim 7 wherein the thermally spraying the running layer comprises spraying a material comprising an aluminum-silicon alloy.

12. The procedure according to claim 11 wherein the spraying material further comprises an additional alloy constituent selected from the group consisting of:

a. iron;

b. nickel;

c. magnesium; and d. copper, the constituent amounting to 0.5 to 2% w/w of the alloy.

13. The procedure according to claim 11 wherein the aluminum-silicon alloy has a silicon content of 12 to 50% w/w.

14. The procedure according to claim 13 wherein the spraying material further comprises an additional alloy constituent selected from the group consisting of:

a. iron;

b. nickel;

c. magnesium; and d. copper, the constituent amounting to 0.5 to 2% w/w of the alloy.

15. The procedure according to claim 7 wherein the thermally spraying the running layer comprises spraying powder having a grain size of less that 150 μm.

16. The procedure according to claim 7 further comprising thermally spraying a carrier layer onto the mandrel before the thermally spraying the running layer.

17. The procedure according to claim 16 further comprising removing the carrier layer from the running layer via machining.

18. The procedure according to claim 17 wherein the removing the carrier layer comprises removing the carrier layer after the running layer of the cylinder bushing poured into the cylinder crankcase has been sized to its cylindrical operating dimensions via machining.

19. The procedure according to claim 16 wherein the carrier layer comprises a constituent from the group consisting of:

a. tin;

b. zinc;

c. aluminum; and d. al alloy of 2 or more of a–c.

20. The procedure according to claim 19 further comprising removing the carrier layer from the running layer via machining.

21. The procedure according to claim 20 wherein the removing the carrier layer comprises removing the carrier layer after the running layer of the cylinder bushing poured into the cylinder crankcase has been sized to its cylindrical operating dimensions via machining.

22. The procedure according to claim 16 wherein the thermally spraying the carrier layer comprises rotating the mandrel.

23. The procedure according to claim 22 wherein the thermally spraying the bonding layer comprises rotating the mandrel.

24. The procedure according to claim 7 wherein the thermally spraying the bonding layer comprises rotating the mandrel.

25. The procedure according to claim 7 further comprising shrinking the mandrel via quenching before the mandrel is removed from the still-heated thermally sprayed cylinder bushing.

26. The procedure according to claim 7 further comprising subjecting the cylinder bushing to heat treatment at a temperature of between 300° C. and 550° C.

27. A procedure for manufacturing a light metal cylinder crankcase for a combustion engine, the cylinder crankcase having at least one cylinder bushing having a running layer that forms a running surface and a rough external bonding layer for bonding the cylinder bushing to the cylinder crankcase while pouring a cylinder crankcase smelt, the cylinder bushing manufactured by thermally spraying the running layer on a mandrel serving as the molded part, wherein at least 60% of the bonding layer relative to the jacket surface of the bonding layer is connected with the casting material of the cylinder crankcase in a material tight manner, the procedure comprising thermally spraying the bonding layer on the running layer in such a way that the bonding layer has an open porosity of at least 10% v/v/;

wherein the temperature of the smelt exceeds the melting point of the bonding layer while pouring the cylinder crankcase.

28. The procedure according to claim 27 further comprising pouring the cylinder crankcase using a pressure-assisted procedure.

29. The procedure according to claim 28 wherein the pouring is performed at a gating rate exceeding 1 m/sec.

* * * * *